US008297766B2

(12) United States Patent
Harbers et al.

(10) Patent No.: US 8,297,766 B2
(45) **Date of Patent: *Oct. 30, 2012**

(54) COLOR TUNABLE LIGHT SOURCE

(75) Inventors: Gerard Harbers, Sunnyvale, CA (US); Mark A Pugh, Los Gatos, CA (US); Menne T de Roos, Saratoga, CA (US); Peter K. Tseng, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/104,285

(22) Filed: May 10, 2011

(65) Prior Publication Data

US 2011/0211344 A1 Sep. 1, 2011

Related U.S. Application Data

(63) Continuation of application No. 12/538,003, filed on Aug. 7, 2009, now Pat. No. 7,942,540.

(60) Provisional application No. 61/087,570, filed on Aug. 8, 2008.

(51) Int. Cl.
*F21V 9/16* (2006.01)

(52) U.S. Cl. ..... 362/84; 362/249.02; 362/247

(58) Field of Classification Search ..... 362/606, 362/607, 611, 612, 555, 563, 84, 166, 167, 362/168, 170, 174, 184, 189, 191, 249.02, 362/311.02, 367, 232, 241, 319, 321–325, 362/281, 283, 279

See application file for complete search history.

(56) References Cited

U.S. PATENT DOCUMENTS

| | | | | |
|---|---|---|---|---|
| 5,959,316 | A | 9/1999 | Lowery | |
| 6,351,069 | B1 | 2/2002 | Lowery et al. | |
| 6,357,889 | B1 * | 3/2002 | Duggal et al. | 362/84 |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,680,569 | B2 | 1/2004 | Mueller-Mach et al. | |
| 6,812,500 | B2 | 11/2004 | Reeh et al. | |

(Continued)

FOREIGN PATENT DOCUMENTS

WO 2007/102098 A1 9/2007

(Continued)

OTHER PUBLICATIONS

International Search Report and Written Opinion mailed on Dec. 4, 2009, for PCT Application No. PCT/US2009/053221 filed on Aug. 7, 2009, by Xicato, Inc., 15 pages.

(Continued)

*Primary Examiner* — Danielle Allen

(74) *Attorney, Agent, or Firm* — Silicon Valley Patent Group LLP

(57) ABSTRACT

A lighting module includes a light output window, at least one side wall that defines a cavity and a mounting plate, and at least one light source, and at least one reflector that is within the cavity. The light output window may be one of the side walls in a side-emitting configuration. The spectral distribution of the light coming out of the light output window may be changed by manipulating the relative position of the side wall to the at least one reflector that is within the cavity.

12 Claims, 10 Drawing Sheets

U.S. PATENT DOCUMENTS

| | | | | |
|---|---|---|---|---|
| 7,126,162 | B2 | 10/2006 | Reeh et al. | |
| 7,250,715 | B2 | 7/2007 | Mueller et al. | |
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 7,942,540 | B2 | 5/2011 | Harbers et al. | |
| 2007/0081336 | A1 | 4/2007 | Bierhuizen et al. | |
| 2007/0236933 | A1 * | 10/2007 | Bierhuizen et al. | 362/293 |

FOREIGN PATENT DOCUMENTS

| | | | |
|---|---|---|---|
| WO | 2008/149250 | A1 | 12/2008 |
| WO | 2008/157080 | A2 | 12/2008 |
| WO | 2009/013695 | A2 | 1/2009 |
| WO | 2009/021859 | A1 | 2/2009 |
| WO | 2009/052099 | A1 | 4/2009 |

OTHER PUBLICATIONS

U.S. Appl. No. 12/538,003, filed Aug. 7, 2009, Harbers.
International Preliminary Report on Patentability mailed on Feb. 17, 2011 for International Application No. PCT/US2009/053221 filed on Aug. 7, 2009 by Xicato, Inc., 8 pages.
Preliminary Amendment mailed on Nov. 5, 2010 for U.S. Appl. No. 12/538,003, filed Aug. 7, 2009 by Harbers et al., 7 pages.
Notice of Allowance mailed on Mar. 29, 2011 for U.S. Appl. No. 12/538,003, filed Aug. 7, 2009 by Harbers et al., 13 pages.

* cited by examiner

COLOR TUNABLE LIGHT SOURCE

CROSS REFERENCE TO RELATED APPLICATIONS

This application is a continuation of U.S. Ser. No. 12/538,003, filed Aug. 7, 2009, which claims the benefit of Provisional Application No. 61/087,570, filed Aug. 8, 2008, both of which are incorporated by reference herein in their entireties.

FIELD OF THE INVENTION

The present invention is related to light sources and in particular to color tunable light sources.

BACKGROUND

Natural daylight, as directly or indirectly provided by the Sun, changes in spectral composition over the day, due to changes in latitude and longitude of the Sun relative to an observer, which changes transmission and scattering paths in the earth's atmosphere, and reflection and scattering of objects near the observer. It is desired to recreate (at least to certain extent) these effects in artificial light sources, by changing the light sources' spectral composition and color of emission, or to be more specific, to change the correlated color temperature of its light output. Potential application would be in retail or residential environments, to change the lighting atmosphere as well as changing the mood and well-being of people. Additionally, it is desired to implement such functionality with only limited added cost, and minimum number of added components, while maintaining a high efficiency (luminous flux output compared to electrical power going in, while maintaining good CRI).

It is also desired to change the color point of solid state light sources which do not meet the target color point specifications. Such deviations for example occur due to production variations in wavelength or efficiency, or due to variations in phosphor conversion efficiency in case phosphors are used to create different spectral components of the light output. These conversion efficiencies can vary due to differences in layer thicknesses, or variations of the phosphor particle concentration in the phosphor layer (or layers), or due to variations in the chemical composition of the phosphor. In this case it is also desired to have the ability to adjust the color point of a solid state lighting module after it has been assembled, so that module meets color point targets.

It is known that modules can be made with strings of red, green, and blue light emitting diodes (LEDs), where each string is attached to a current source, and where each of the current sources can be adjusted to change the relative light output of the red, green and blue emitting LEDs, so that different shades of white or any other color can be produced. Some drawbacks of this approach are that multiple drivers are required, which increases the number of components needed and costs, and that only a portion of all the LEDs are used at full capacity at any given time. If, for example, light with a high correlated color temperature is desired, which has a relative high blue content, the blue LEDs are driven at maximum drive condition, while the green and in specific the red LEDs are driven at a current much below their typical drive currents. If however a light output with a low correlated color temperature is required, the red LEDs are driven to a maximum, while the blue LEDs are driven at a much lower current than typical. On average, the number of LEDs required is more than if the system would be optimized for only one color point.

Furthermore, due to varying drive conditions the efficiency of the LEDs varies (due to the so called current and temperature droop), which requires more electronics to predict the actual color of the light output in relation to the drive current. Typically this is done with a micro-controller, and very often additional measurements of for example the board temperature are required as inputs for the algorithms programmed in the micro-controller. This approach has an additional drawback, in that the devices suffer from differential aging. For example, red LEDs can degrade faster than the blue LEDs if they are driven harder, or blue LEDs can degrade faster, when the device is operated at relatively high color temperatures. With respect to differential aging the situation is even worse, since it is known that LEDs aging (degradation of the light output at same input power over time) can differ from device to device.

A solution for this is to use a technique where at least three sensors are used, each of the sensors having different spectral responses, and where the signals of the three sensors are measured and used to get an estimate of the actual color point of the output of the module. This measurement is then used to control the currents through the strings of red, green and blue LEDs using an electronic feedback control. Such a technique is commonly referred to as an optical feedback technique. Drawbacks of this approach include an increasing number of components, and the need of embedded micro-controllers, which of course results in additional costs, and increased chances of electronic failure.

Besides using red, green and blue light emitting diodes in these systems, combinations of other colors can be used, including white LEDs, or a combination of white LEDs having different correlated color temperatures.

An example of a system where white and red LEDs are used is the system produced by LED Lighting Fixtures (NC, USA), which was recently acquired by CREE (NC, USA). The system is a down-light module with a mixing cavity using yellow LEDs in combination with red LEDs to produce a warm white color, and a sensor which is used to measure the relative light output of the yellow versus the red LEDs, and to maintain a constant color for the light output of the down light. This system is not designed to change the color of light output at request of the user of the system, but the color can be set by adjusting the control conditions at the factory.

SUMMARY

A lighting module includes a light output window, at least one side wall that defines a cavity and a mounting plate, and at least one light source, and at least one reflector that is within the cavity. The light output window may be one of the side walls in a side-emitting configuration. The spectral distribution of the light coming out of the light output window may be changed by manipulating the relative position of the side wall to the at least one reflector that is within the cavity.

DETAILED DESCRIPTION

Figure 1A:
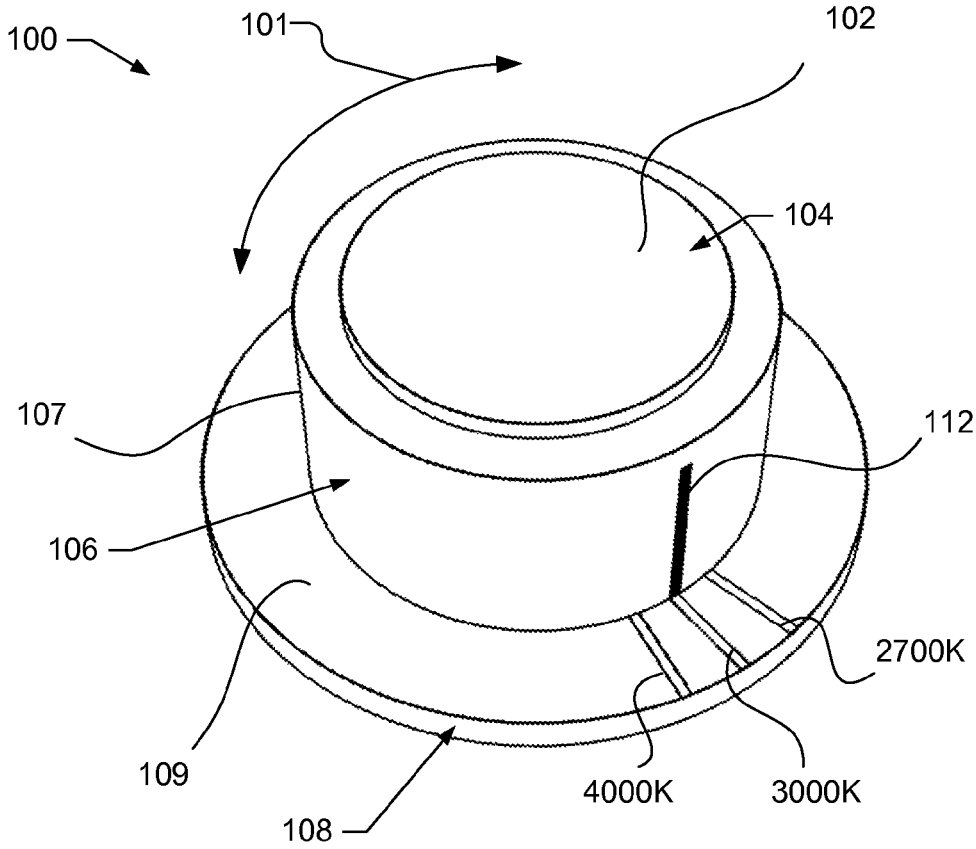
FIG. 1A illustrates a perspective view of a cylindrical top light emitting module.

FIG. 1A shows an embodiment of a cylindrical module 100. The module has a light output window 102 at the top 104, a middle section 106 with side walls 107, and a bottom section 108 which may include a mounting plate and heat spreader 109, and a cavity 110 (see FIG. 4A) within the module.

In this embodiment, the middle section 106 can be rotated relative to the bottom section 108, as illustrated by arrow 101. The rotation will change the optical characteristics of the cavity 110 formed by the top 104, middle 106, and bottom 108 sections, such that the spectral output of the light coming through the output window 102 is changed. This will be explained in more detail in the following sections.

The middle 106 and bottom 108 sections may have engraved lines, letters or any other indications 112 which give the installer or user of the lighting module an indication of the light output correlated with the relative orientation of the middle section to the top section. As illustrated in FIG. 1A, three lines are indicated at the bottom section 108, with one line on the middle section 106. If the line at the middle section 106 is aligned with the right line at the bottom section 108, the module 100 generates a white light through the top window 102 with a correlated color temperature (CCT) of approximately 2700K. By rotating the middle section 106 to the left, white light with a CCT of 3000K or 4000K can be generated, by aligning the line at the middle section 106 with the middle or left line at the bottom sections respectively.

Figure 1B:
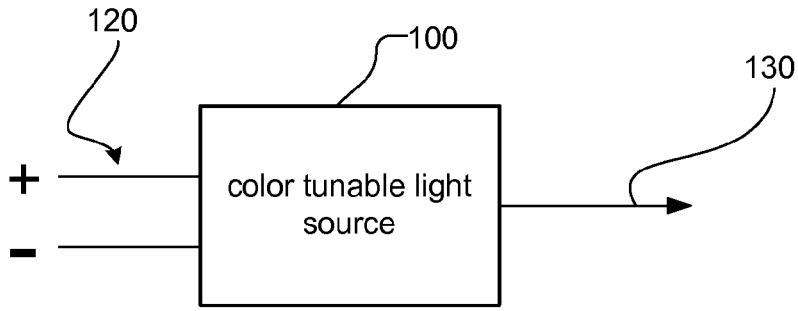
FIG. 1B illustrates schematically, the operation of a light emitting module.

FIG. 1B schematically illustrates the color tunable module 100 as receiving electrical inputs 120 and producing a light output 130 with a variable spectrum.

Figure 2:
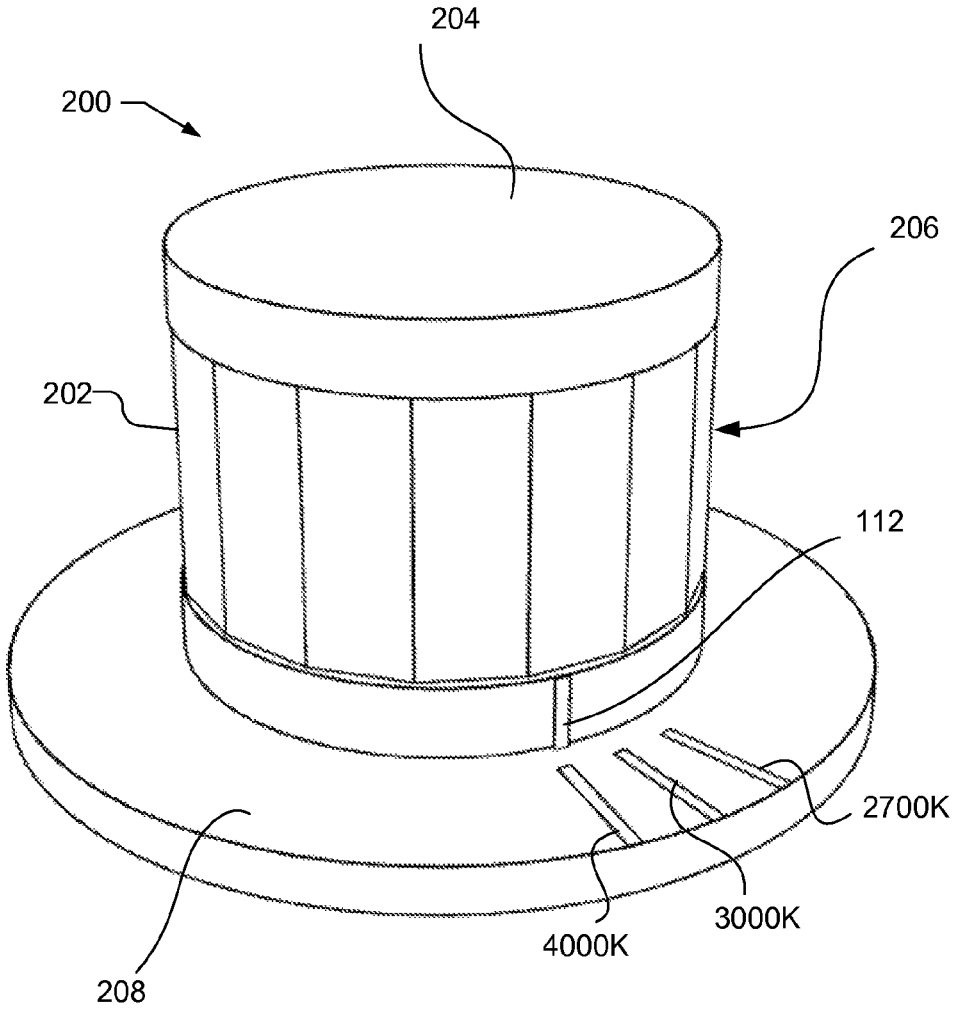
FIG. 2 illustrates a perspective view of a cylindrical side light emitting module.

FIG. 2 shows an embodiment of a cylindrical module 200, similar to the one shown in FIG. 1 with indicator lines 112, but it is configured to emit light through the side walls 202, and the top 204 is made of a reflecting material. In this configuration the color of the light output can be changed by rotating the top section 204 and/or middle section 206, i.e., side walls 202 with the light output window, compared to the bottom section 208, by changing the optical characteristics of the internal cavity formed by the top reflector, the translucent side walls 202 of the middle section 206, and the bottom section 208 that may include a mounting plate and heat spreader.

Figure 3A:
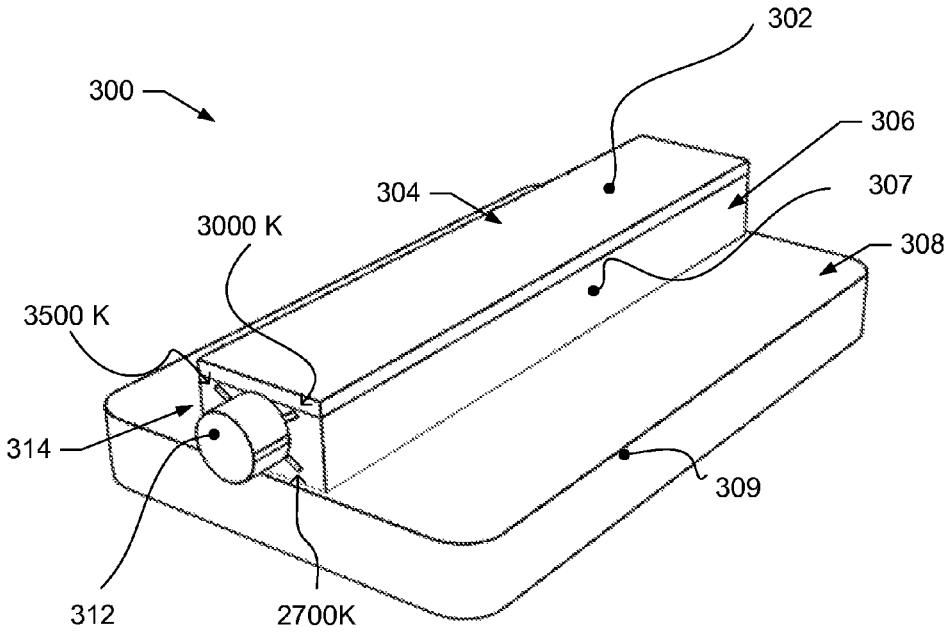
FIG. 3A illustrates a perspective view of a linear top light emitting module.

FIG. 3A shows an embodiment of a linear module 300. This module has a rectangular light output window 302 at the top section 304 and includes a middle section 306 with side walls 307, and a bottom section 308 that may include a mounting plate and heat spreader 309. In this embodiment the module 300 has an adjustment knob 312, which can be rotated to change the spectral properties of the light emitted through the light output window 302. In this case the knob 312 and middle section 306 can have engraved lines, letters or any other indications 314 which give the installer or user of the lighting module 300 an indication of the light output correlated with the relative orientation of the knob 312 to the housing defined by the middle section 306.

Figure 3B:
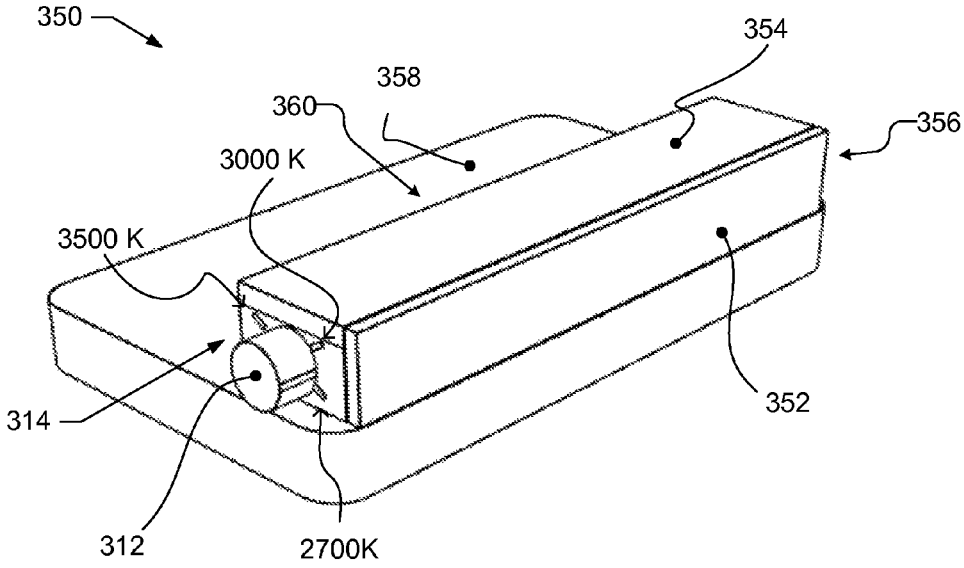
FIG. 3B illustrates a perspective view of a linear side light emitting module.

FIG. 3B shows an embodiment of a linear module 350 with a side-emitting structure, in which the light output window 352 is placed at a side section 356 of the module 350. The module 350 has a rectangular light output window 352 at one side of the side section 356, and reflective walls on the side section 356 at the side 360 opposite the window 352, and adjacent to the light output window 352 at the top 354 and the bottom section 358, which may include a mounting plate and heat spreader. In this embodiment, the module 350 also has an adjustment knob 312, which can be rotated to change the spectral properties of the light emitted through the light output window 352. Again, the knob 312 and middle section 356 can have engraved lines or letters or any other indications 314 which give the installer or user of the lighting module an indication of the light output correlated with the relative orientation of the knob to the housing.

Figure 4A:
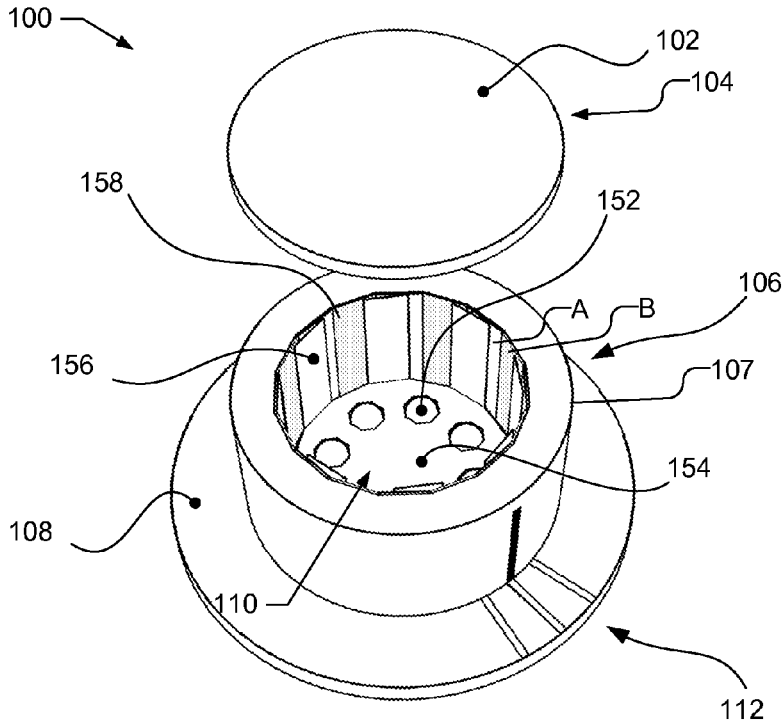
FIGS. 4A, 4B, and 4C illustrates perspective views of the cylindrical top light emitting module from FIG. 1 with the top window removed in various configurations.

FIG. 4A shows a perspective view of the cylindrical module 100 from FIG. 1 with the light output window 102 removed to show the internal cavity 110 of the module. The light output window 102 consists of a translucent plate, and might contain wavelength conversions elements, such as phosphors, which might be dispersed in the material of the window 102, or might be applied as a coating on the surface facing the internal cavity, or the surface facing outward, or be applied as a coating on both surfaces. If a phosphor is used it is beneficial to use plates which have a high thermal conductivity, such as plates containing or made of aluminum oxide, which in mono-crystalline form is called Sapphire, or in poly crystalline form is called Alumina. The light output window 102 has low absorption at the wavelengths emitted.

As can be seen in FIG. 4A, the cylindrical module 100 includes a number of light emitters 152, a bottom reflector 154, a number of side reflectors 156, and the inside wall 158 of the middle section 106.

The light emitters 152 are for example light emitting diodes, such as manufactured by Philips Lumileds Lighting (CA, USA), or Nichia Corporation (Japan), or Cree (NC, USA). In particular the Luxeon Rebel, as manufactured by Philips Lumileds Lighting, is a light emitting diode package that may be used in the module 100, but other light emitting semiconductors, or other light sources such as lasers, or small discharge lamps, can be used as well. Typically 4 to 12 light emitters 152 are used, depending on the required electrical input and/or radiometric output power.

The light emitters 152 are attached to a circuit board and a heat sink (not visible in these drawings). The mounting board contains electrical connections for the light emitters 152, and has thermal contact areas (preferably on both sides of the board) and vias to reduce the thermal resistance from the light emitters 152 to the heat sink. Blue or UV emitting light emitters 152 may be used, but a combination of blue, UV, green, amber, or red light emitters 152 can be used as well.

In order to achieve a good luminous efficacy (high light output versus electrical power input ratio), all the internal surfaces of the cavity 110 formed by the light output window 102, side reflectors 156 and inside wall 158, and bottom section 108 may have a low optical absorption. For that purpose, the bottom reflector 154 may be formed from the circuit board coated with a material with high reflectivity, or a highly reflective plate may be mounted over the circuit board. For example, in FIG. 4A, a highly reflective plate is shown as the bottom reflector 154, which has circular areas stamped out to provide optical access to the lenses of the light emitters 152.

An example of such a reflective plate is a plate made of a material called Miro, which is produced by a company called Alanod (Germany). The reflective plate may be thin, preferably less than 0.5 mm, but preferably less than 0.25 mm.

As illustrated in FIG. 4A, side reflectors 156 are attached to the bottom reflector 154. The bottom reflector 154 and side reflectors 156 can, for example, be stamped out of one plate, where each of the side reflectors 156 is bent upwards and is mounted over the light emitters 152 by bringing this structure down into the cavity 110. The bottom reflectors 154 and the side reflectors 156 may be directly or indirectly attached to the bottom section 108 (for example by gluing, or screwing), and do not rotate with the middle section 106 with side walls 107. The bottom reflector 154 and/or side wall reflectors 156 may be covered with a highly reflective diffuse coating, such as coatings containing titanium dioxide, magnesium dioxide, or aluminum dioxide particles, or might contain wavelength converting materials such as phosphors.

The middle section 106 in this embodiment has an internal side wall 158, which has a low absorption (such as am aluminum or silver coating), and is at least partially covered with a spectral conversion layer such as a phosphor layer.

In one embodiment eight light emitters 152 and eight side reflectors 156 are used, so that the internal side wall of the cavity 110 is divided into sixteen sections. Eight of the sixteen side wall sections are coated with a layer having a first reflection, e.g., spectral reflectivity, property (denoted by side wall section A), the other eight of the sixteen side wall sections having a second reflection, e.g., spectral reflectivity, property (indicated by side wall section B). The two groups of areas with different reflection properties are inter-spaced.

Figure 4B:
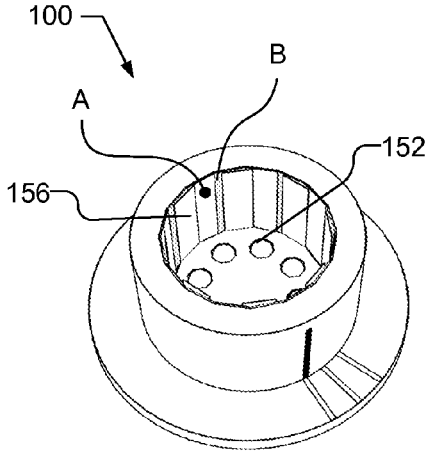
Figure 4C:
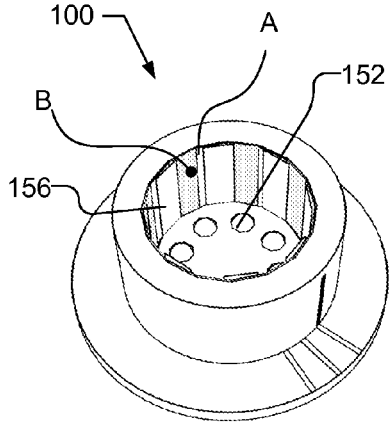

In one orientation side wall sections A are almost completely exposed to the light emitters 152, while side wall sections B are hidden from exposure because they are behind the side reflector 156, as illustrated in FIG. 4B. In FIG. 4C, the module has the opposite orientation, side wall section B is completely exposed to the light output of the light emitters 152, while the side wall sections A are covered by the side reflectors 156.

In one embodiment, the coatings of the bottom reflector 154 and/or side reflectors 156, the coatings of the internal side wall 158, and the coatings of the light output window 102 are chosen such that if side wall sections A are completely exposed, white light is generated with a correlated color temperature of approximately 4000K, while if side wall section B is completely exposed white light with a correlated color temperature of approximately 2700K is obtained. By partially exposing side wall section A and side wall section B white light with correlated color temperatures in between 2700K and 4000K can be obtained.

Although in this embodiment eight light emitters 152 are used, other numbers of light emitters 152 and side reflectors 156 can be used as well. Also, the number of side wall sections with different reflective property may be greater than the 2 sections, i.e., section A and section B, illustrated. Further, while the side wall sections and the side reflector are illustrated as vertical stripes, other configurations may be used.

Figure 5:
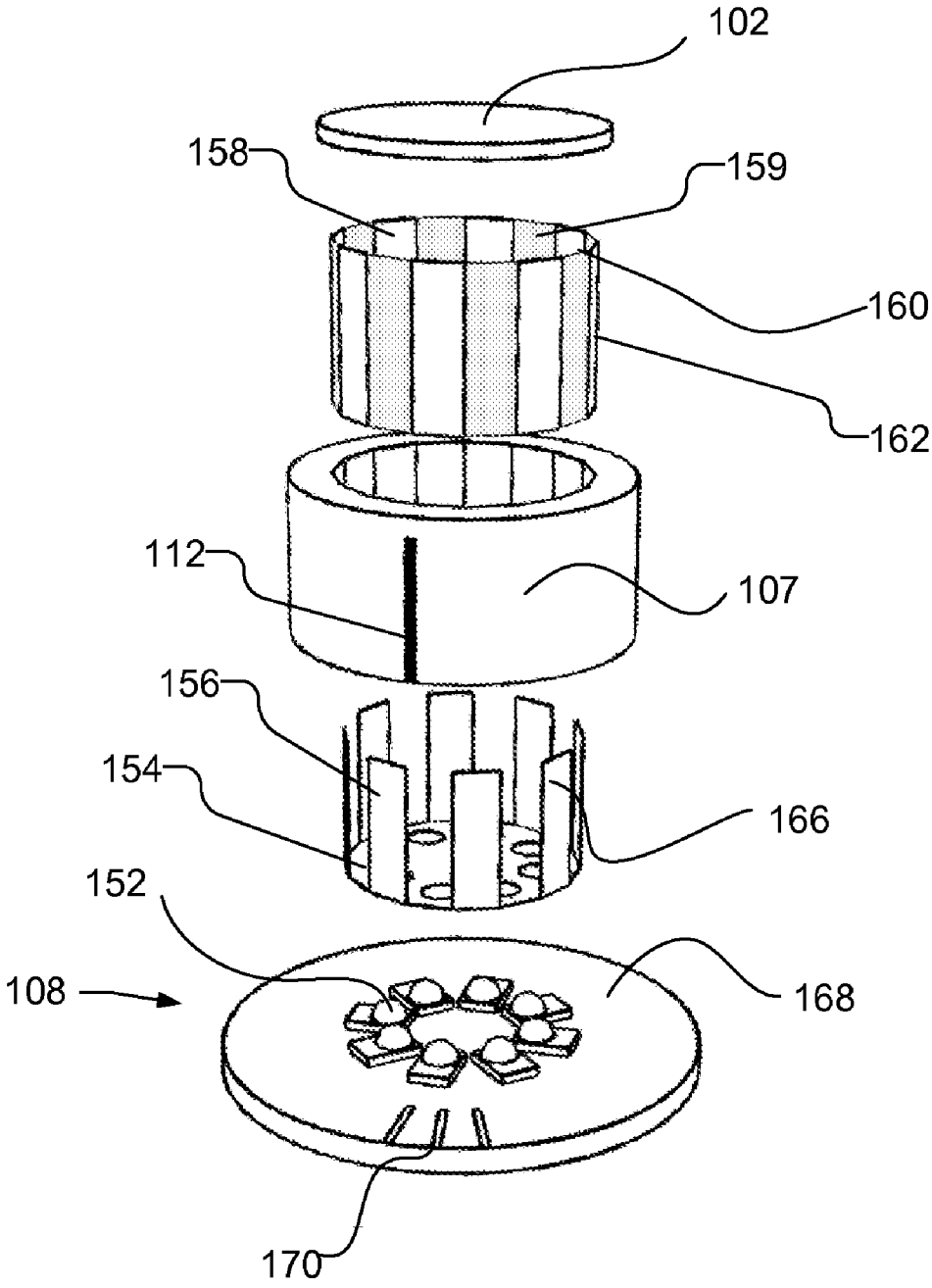
FIG. 5 illustrates an exploded perspective view of the cylindrical top light emitting module from FIG. 1.

FIG. 5 is an exploded view of one embodiment of the cylindrical module 100 from FIG. 1, where the parts are individually shown. The top element in FIG. 5 is the light output window 102, which has translucent optical properties. The window 102 is illuminated with light generated by the light emitters 152, either directly or indirectly when reflected from the other components in the cavity before it hits the window 102. Part of this light is transmitted by the window 102 and is emitted from the module from the top. During the transmission through the plate the light gets at least partially redistributed, for example by scattering of light by particles contained in, or attached to the window 102, or by scattering of the light by making at least one of the two surfaces of the window rough, which can be done for example by sandblasting such a surface.

The second element visible in this figure is a segmented cylindrical ring 160, having an inside wall 158 and an outside wall 162, where the surface of the inside wall is at least partially covered with an optical coating 159, and where this optical coating 159 changes the spectral properties of the light reflected by the coating. Such an optical coating 159 may contain a dye, or a phosphor material (such as a yellow phosphor YAG ($Y_3Al_5O_{12}$:Ce) material, or a green phosphor material $Ca_3Sc_2Si_3O_{12}$:Ce, or another green phosphor $Ca_3(Sc,Mg)_2Si_3O_{12}$:Ce, or another green phosphor $CaSc_2O_4$:Ce, or a red phosphor $CaAlSiN_3$:Eu, or another red phosphor $(Sr,Ca)AlSiN_3$:Eu), or might be a thin film coating, consisting of thin layers of different materials, where the thickness and type of materials determine the spectral reflection properties. In one embodiment, the inside surface 158 is subdivided into a total 16 sub-sections, where the sub-sections alternating do have or do not have such a coating, or have alternating coatings with different compositions of optical coatings. The ring 160 is preferably made from a highly reflective material, and preferably is made of a material which has a good thermal conductivity, such as aluminum based reflective material. These type of reflective materials are for example made by Alanod (Germany), and have the brand name Miro, but similar materials are produced by other companies as well. The ring 160 can for example made be applying the reflective coatings on a flat strip of this reflector material, and bending the reflector after the coating 159 has been cured.

The third element depicted in this figure is a side wall 107 that is used as an adjustment piece and is part of the housing of the module 100 into which the coated cylindrical ring 160 is placed and attached, and to which the output window 102 is attached at the top. The side wall 107 is made of material which has good thermal conductivity such as copper or aluminum. The side wall 107 piece can have markers 112 or indicators to mark the relative orientation of the adjustment piece (with the attached coated ring 160) with respect to the bottom piece 108 that includes a mounting plate or bottom heat sink. In addition, the side wall 107 adjustment piece can have a surface structure that facilitates manual rotation of the adjustment piece, or might have mounting features which allows for attachment of a motor to rotate the adjustment piece by remote control.

The fourth element shown is a reflector structure 166, consisting of a bottom reflector 154 in the form of a circular disk with stamped out holes to fit the disk around the optical output apertures of the light emitters 152, and side reflectors 156 formed as rectangular reflector elements attached to this disk, which are placed in a direction perpendicular to the disk, and have approximately the same height as the ring 160. This reflector structure is preferably made of a highly reflective material and can for example be injection molding, or can be formed out of a highly reflective metal plate by stamping and bending. An example of such a metal plate material is the Miro material, as produced by Alanod (Germany).

The last element is the bottom structure 108 including a mounting plate 168, to which the light emitters 152 and the reflector structure 166 are attached. The mounting plate 168 is for example composed of an Aluminum or Copper disk, on top of which a printed circuit board is attached. The printed circuit board provides electrical connection to the light emitters 152, which are soldered to the board by the well known re-flow soldering technique. Electrical wires are soldered to the board so that the light emitters can be attached to and operated by an electronic driver. Besides a separate circuit board and metal disk or plate, also a so called metal (or aluminum) core printed circuit board can be used, as produced for example by Siena Proto Express (Sunnyvale Calif., USA). Besides a plate, the circuit board can also be directly attached to a heat sink, or a fan or other cooling devices. The bottom structure 108 also can have markers 170, indicators, or engravings indicating the relative rotation of the adjustment piece to the mounting plate, or indicating the associated color or color temperature of the light output.

Figure 6:
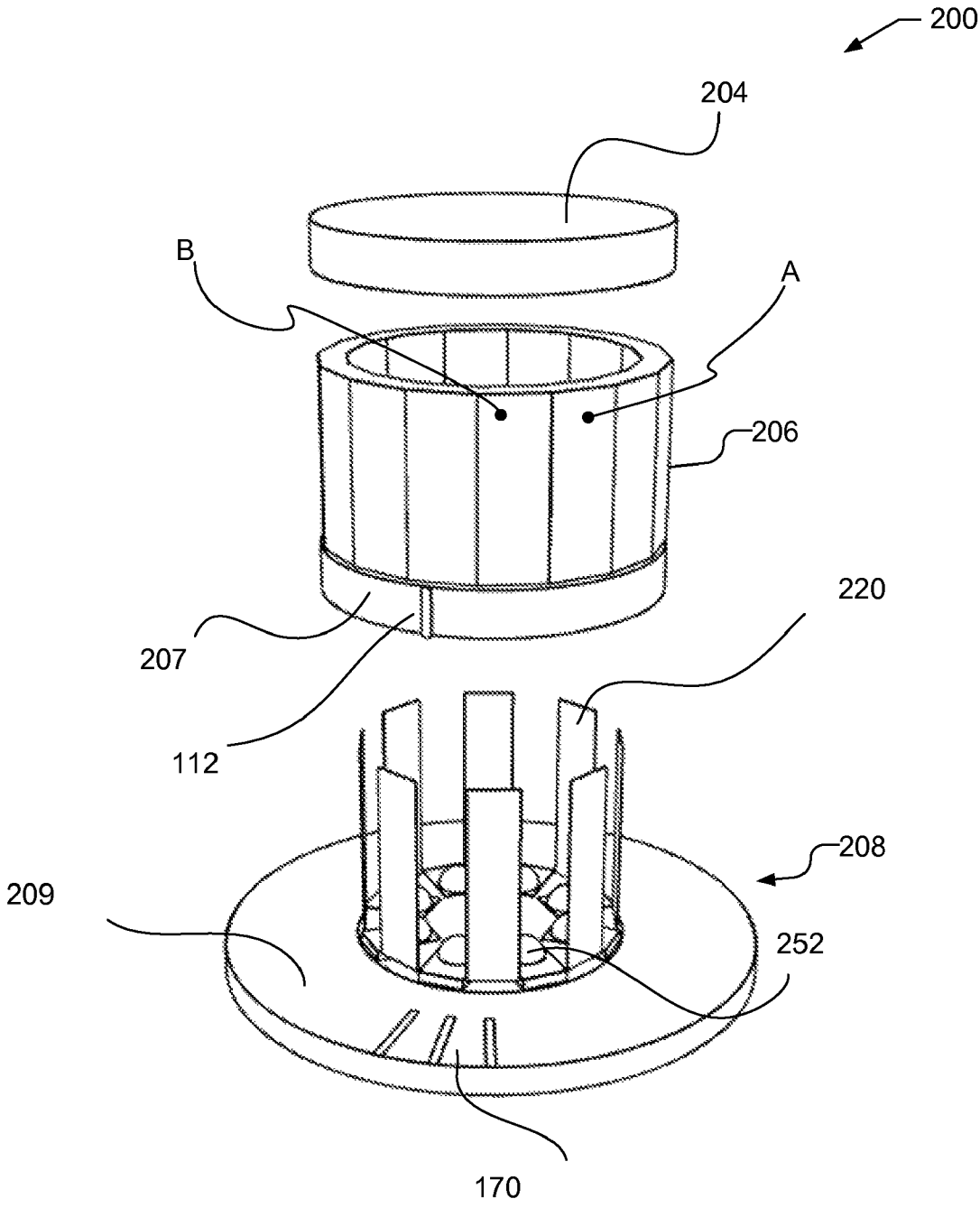
FIG. 6 illustrates an exploded perspective view of the cylindrical side light emitting module from FIG. 2.

FIG. 6 shows an exploded view of the cylindrical side emitter module 200 of FIG. 2. The module 200 includes the top reflector 204, which can be a plastic piece, having a high diffuse or specular reflecting surface at the side facing the light sources, or is made out of a highly thermally conductive and optical reflective material such as the Miro material as made by Alanod. The top reflector 204 can also be made out of a piece of metal, and coated with a highly reflective material, for example containing one or more of the materials denoted by the chemical formulas $TiO_2$, $MgO_2$, ZnO, $AlO_2$, $BaSO_4$, $Y_3Al_5O_{12}$:$Ce_3$+, $Sb_2O_3$, $Ca_3Sc_2Si_3O_{12}$:Ce, $Ca_3(Sc,Mg)_2Si_3O_{12}$:Ce, $CaSc_2O_4$:Ce, $CaAlSiN_3$:Eu, $(Sr,Ca)AlSiN_3$:Eu. The materials in this list containing the chemical elements Ce or Eu or examples of luminescent materials called phosphors, which convert blue or UV light into light having longer wavelength components, having cyan, green, yellow, amber, or red colors. Typically these material are added to a transparent binder material, such as an epoxy or a Silicone, and applied to a surface as a coating by screen printing, doctor blading, tape casting, or spray painting, or any other suitable coating technique. Layer thickness can vary but is typically in the range of 30 to 100 micrometer.

Attached to the top reflector 204 is the side wall section 206, which in this embodiment is made of a material with low absorption, and may have scattering properties. The side walls 206 has a cylindrical or polygon shaped cross section. In one embodiment, the side walls 206 is made out of a material having different powders, such as a combination of $AlO_2$ and a phosphor such $Y_3Al_5O_{12}$:$Ce_3$+, and the powders are compressed in a cylindrical shape using a mold and sintered in an oven. In another embodiment, the side walls 206 is made out of a glass, or sapphire tube, and coated with a powder on the inside or the outside of the tube. Coating tubes with powders is a very common technology for making light sources, such as fluorescent tubes, and the same techniques can be used in this application.

To achieve the changes in spectral composition of the light output of the module in this configuration, the side walls 206 has at least two groups of striped sections, identified as A and B. Each of the groups having at least one member (striped section), where the striped sections differ in spectral transmission properties (or 'color'). The striped sections A and B on the side walls 206 may be formed by co-extrusion of two materials, where the two materials differ in spectral transmission properties. One of the materials may contain a phosphor mixture producing a light output with an approximate correlated color temperature of 4000K, while the other material may contain a phosphor mixture producing a light output with an approximate correlated color temperature of 2700K. Besides the phosphor mixtures, the material has a binder material, such as aluminum oxide power, and might contain other materials to facilitate the co-extrusion process. Co-extrusion is a well known process: a simple example is the production of striped drinking straws, where for example a red plastic material is co-extruded with a white plastic material. If powders are used a molding technique can be used, where the powders or injected and compressed under high pressure, and heated to melt together. As an alternative, the side walls 206 can be build of rectangular pieces of different materials, which are glued or mechanically mounted to form a polygon shaped cross sectional shape.

The module 100 includes a set of reflectors 220 between the striped sections A, B of the side walls 206 and the light emitters 252. In one embodiment, the set of reflectors 220 is attached to the mounting plate 209 at the bottom section 208 of the module 200. If desired, the reflectors 220 may alternatively be mounted to the top reflector 204, in which case the top reflector 204 and the side wall section 206 are rotatably coupled. In the embodiment shown in FIG. 6, the side walls 206 and the top reflector 204 can rotate relative to the bottom section 208 with help of an optional ring 207 at the bottom of the side walls 206. The ring 207 may be snap fitted to the mounting plate 209 with enough play that the ring 207 and attached side walls 206 and top reflector 204 can be rotated by hand, or by using a tool or a motor. The ring 207 may include a markers 112 or indicators to mark the relative orientation of the ring 207 with respect to the markers 170 on the bottom section 208. In one mode of operation, the orientation of the side wall 206 compared to the reflectors 220 is such that mainly striped sections A are illuminated by the light emitters 252, and the module produces light with a relative low correlated color temperature (such as 2700K, or 3000K). In another mode of operation, the orientation is such that only striped sections B are illuminated, and light with a relative high correlated color temperature is obtained from the module (such as 3500K or 4000K). The reflectors 220 are preferably made of a highly reflective material (a material which has a low absorption for visible light), and may contain phosphor particles, or other particles, which scatter the light. These particles might be embedded in the material forming the reflector 220, such as a polymer material (if the reflectors are injection molded from a plastic material), or can be embedded in material which is used to coat the reflectors 220 (to give it a high reflectivity). If phosphors are used it is preferred to choose a material which has a high thermal conductivity, such as aluminum or copper. As an alternative for using metals, also thermally conductive polymers can be used as a base material, such as for example produced by Cool Polymers, Inc, located in Warwick (RI, USA).

The bottom section 208 of the module 200 in this embodiment contains the light emitters 252, which are attached to the mounting board 209, which contains electric conducting traces for applying current to the light emitters. The mounting board 209 may be made of a material with high thermal conductivity, or contains thermal paths with high thermal conductivity, such as copper vias in an FR4 printed circuit board. The mounting board 209 is preferably attached to a heat spreader, made out of a material with high thermal conductivity such as aluminum or copper. The heat spreader can be made from a thermally conductive polymer, such as for example produced by Cool Polymers, Inc, located in Warwick (RI, USA). Examples of these materials are thermally conductive Liquid Crystalline Polymers (LCP), Polyphenylene Sulfides (PPS), and thermoplastic elastomers (TPEs).

Figure 7:
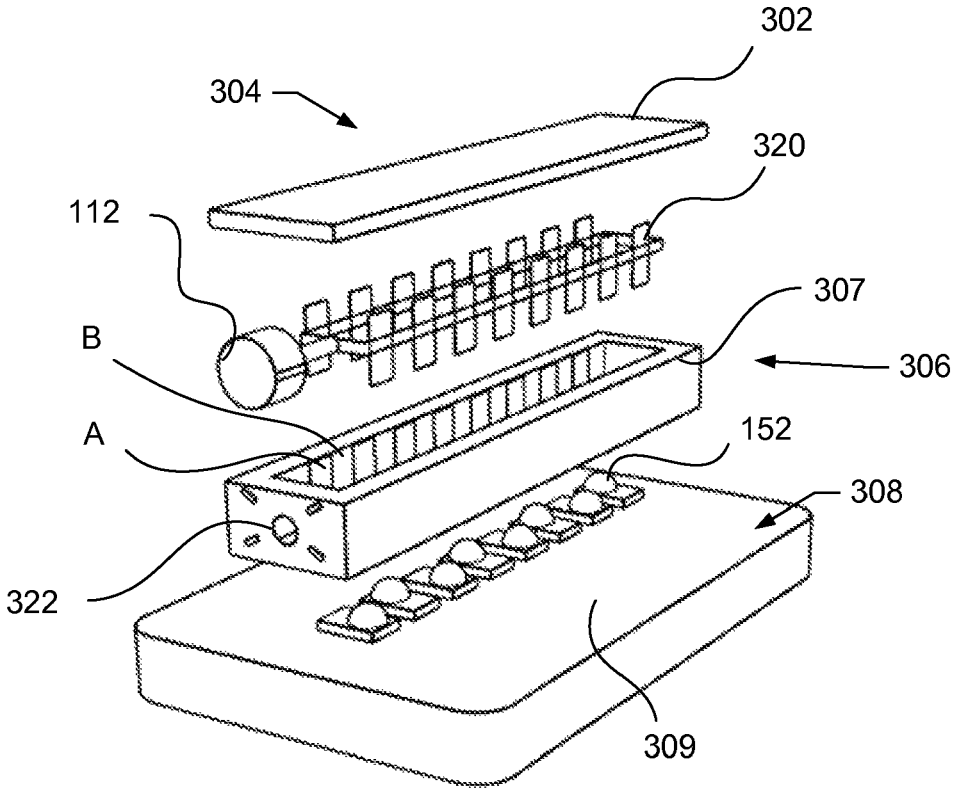
FIG. 7 illustrates an exploded perspective view of the linear top light emitting module from FIG. 3A.

FIG. 7 shows an exploded view of the linear module 300 shown in FIG. 3A. The linear module 300 is similar to the cylindrical module 100 shown in FIGS. 1 and 4, but differs in several ways. The linear module 300 includes a light output window 302 that has a rectangular shape, which may have a width of 5 to 15 mm, and a length of 25 to 75 mm, but other widths and lengths may be used as well. Additionally, unlike the cylindrical module 100, the linear module 300 does not move or rotate the side walls. The linear module 100 includes a set of reflectors 320 that are linearly translated in the cavity 310 formed by the top section 304, the side section 306 and bottom section 308. The reflectors 320 are moved linearly by means of an adjustment screw 312, which translates the reflector structure by rotating it using a tapped hole 322 located in the side wall 307. The side wall 307 is mounted to the mounting plate 309. The side wall 307 is coated with areas of at least one optical coating, which changes the color of the light upon reflection. Preferably, there are two sets of coated areas A and B, each set of areas having at least the number of areas as the number of reflectors in the reflector structure 320. If one of the coated areas A is exposed to the light from light emitters 152, the light output of the module 300 has a correlated color temperature of approximately 2700K, and where if the other set of areas B is exposed to the light of the light emitters 152, the light output of the module has a correlated color temperature of 4000K. Besides this range, it is also possible to tune the module to emit smaller or larger correlated color temperature ranges.

Figure 8:
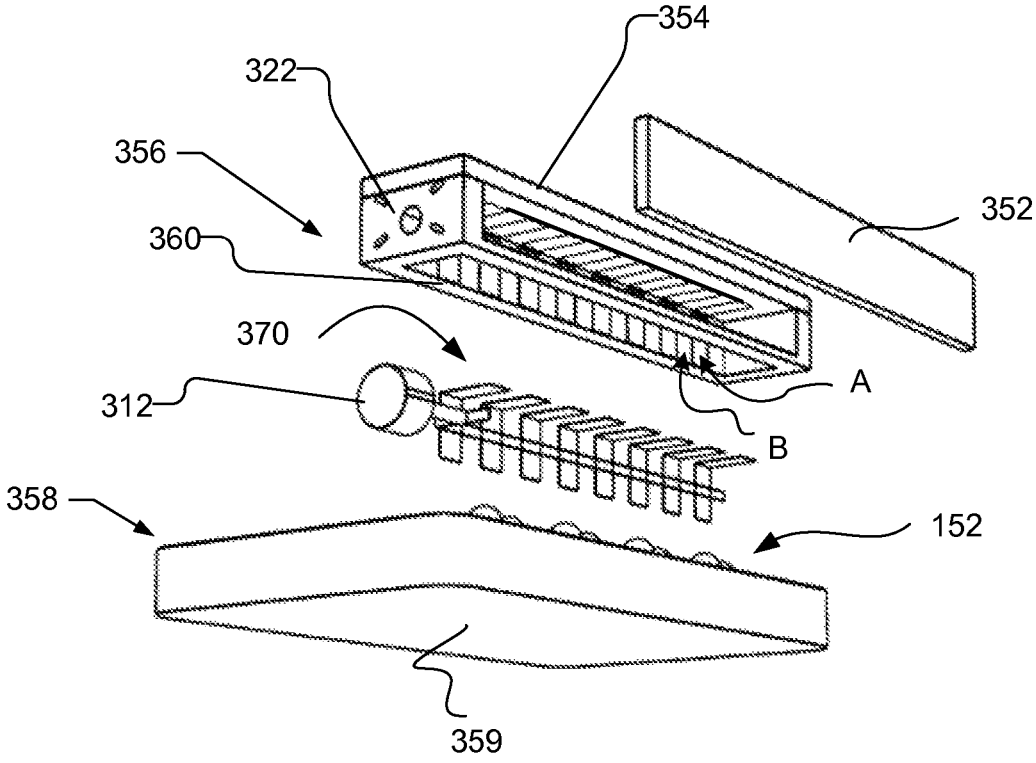
FIG. 8 illustrates an exploded perspective view of the linear side light emitting module from FIG. 3B.

FIG. 8 shows an exploded view of the linear side emitter module 350 shown in FIG. 3B, in which the light output window 352 is placed orthogonal to the mounting plate 359 of the bottom section 358. The linear side emitter module 350 of FIG. 8 is similar to the line module 300 shown in FIG. 7, like designed elements being the same. The linear side emitter module 350, however, has the light output window 352 positioned orthogonal to the mounting plate 359. This configuration is beneficial in applications such as shelf lighting, illustrated in FIG. 9, where the height of the module 350 needs to be small. In the linear side emitter module 350, the reflectors 370 consist of L-shaped mirrors, which cover the side wall 360 opposite the light output window 352, and the top wall 354, which is opposite the light emitters 152. Coated areas A, B are placed on this side wall 360 and the top wall 354. For the rest this configuration functions similar to the embodiment as shown and described under FIG. 7.

Figure 9:
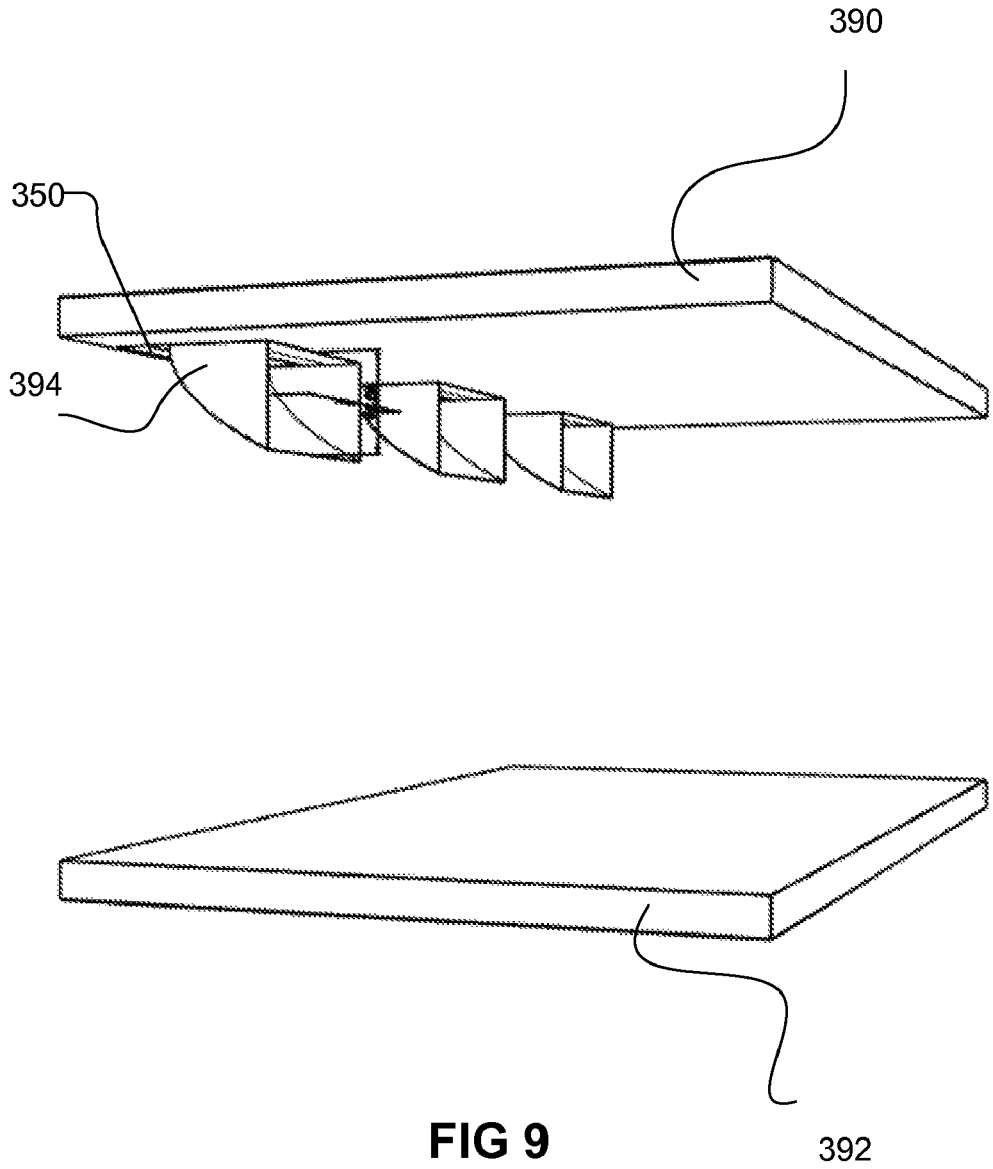
FIG. 9 illustrates an example of a linear side light emitting module used as a shelf light.

FIG. 9 illustrates an example of a linear side emitter module 350 used as a shelf light. If desired, the linear module 300 from FIGS. 3A and 7 may be used. The module 350 itself is not visible in FIG. 9 as it is hidden behind the reflector 394, and is integrated in the upper shelf 390 to illuminate the bottom shelf 392. The top shelf 390 may act as heat spreader and heat sink. As illustrated three modules 350 may be used to illuminate the bottom shelf 392 evenly. Alternatively, the module 350 may be used as a "wall-washer" fixture, to illuminate a wall, as an outdoor light, or to otherwise create architectural effects.

Figure 10:
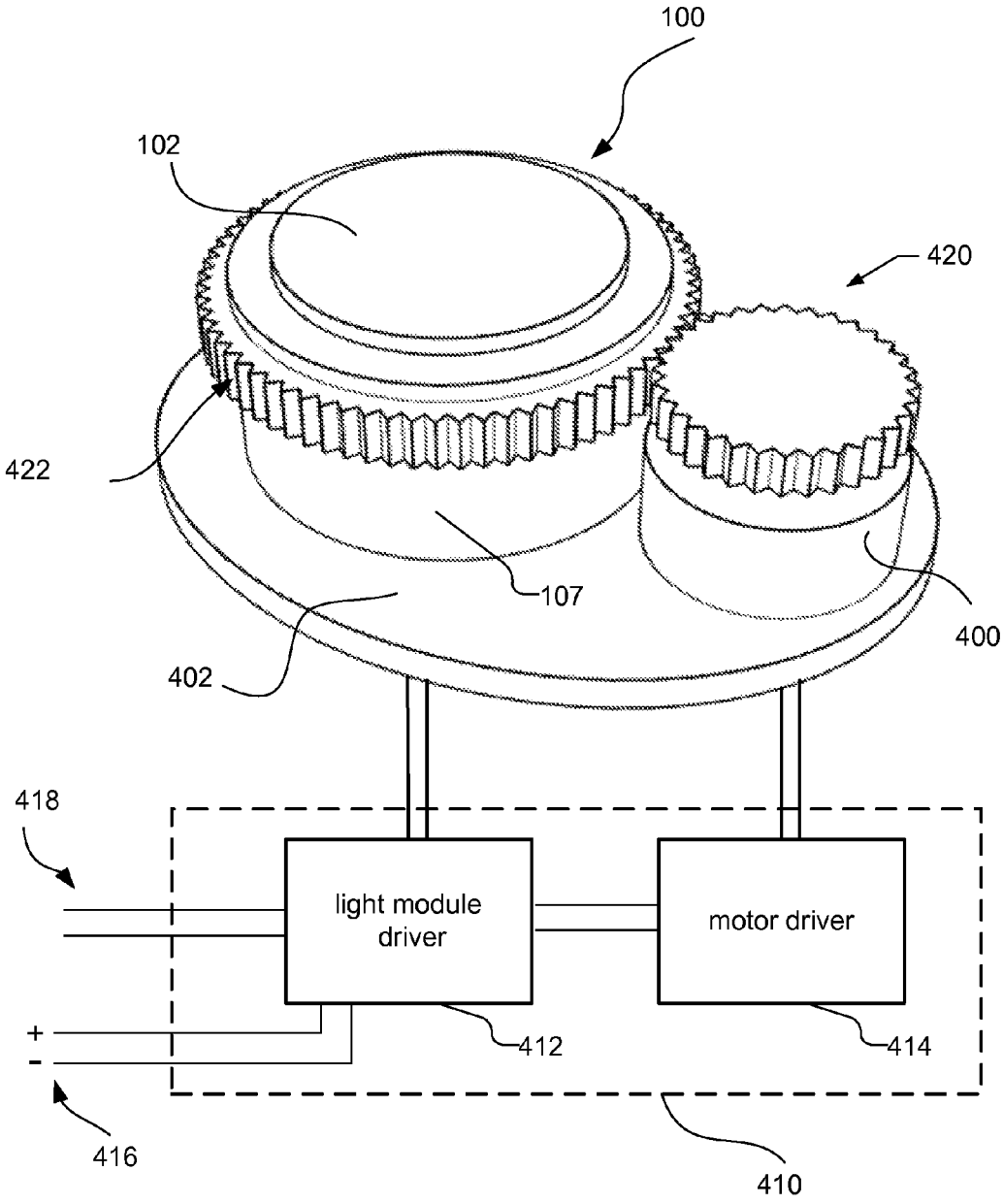
FIG. 10 illustrates an embodiment in which a motor is used to rotate the side wall of a cylindrical module.

FIG. 10 illustrates an embodiment in which a motor 400 is used to rotate the side wall 107 of the cylindrical module 100 shown in FIG. 1. It should be understood, however, that the motor 400 can be used with any of the embodiments described herein. In this embodiment, the cylindrical lighting module 100 is placed on a mounting plate 402, and adjacent to the lighting module 100 is an electric motor 400 mounted on the same mounting plate 402. A control box 410 is included with drivers 412 for the array of light emitters in the module, and a driver 414 for the motor 400. The control box 410 is attached to a power supply (or directly to the mains), as illustrated by power lines 416, as well as a control interface as illustrated by control lines 418. The control interface may be a DMX512 interface, which is a lighting control interface defined by standard "E1.11, USITT DMX512-A" (in short "DMX512-A") and is maintained by ESTA (Entertainment Services and Technology Association). Gears 420, 422 are coupled to the motor 400 and to the side wall 107, respectively. When activating the motor 400, the side wall 107 rotates, and consequently, the spectral output of the module 100 is changed as discussed above. This configuration has the benefit that if the fixture, which holds the module 100, is not easily accessible or is hot, it still can be easily operated to change the color.

Although the present invention is illustrated in connection with specific embodiments for instructional purposes, the present invention is not limited thereto. Various adaptations and modifications may be made without departing from the scope of the invention. Therefore, the spirit and scope of the appended claims should not be limited to the foregoing description.

What is claimed is:

1. A lighting module comprising:

at least one light emitting diode (LED) operable to emit light having a first color;

a cavity defined by a top, a bottom and a middle section, wherein the at least one LED is disposed within the cavity, at least one of the top and the middle section being transluscent;

a plurality of wavelength converting areas within the cavity, the plurality of wavelength converting areas comprising wavelength converting material that converts light having the first color to light having a second color, wherein the light having the first color and the light having the second color are combined and emitted by the cavity as combined light, wherein at least a portion of the combined light is emitted through the middle section;

a plurality of reflective elements within the cavity, wherein at least one of the plurality of reflective elements and the plurality of wavelength converting areas are movable with respect to the other to position the plurality of reflective elements to selectively block a desired portion of the light emitted from the at least one LED from being incident on the plurality of wavelength converting areas to select a correlated color temperature of the combined light emitted by the cavity.

2. The lighting module of claim 1, wherein the plurality of wavelength converting areas further comprising a second wavelength converting material that converts light having the first color to light having a third color, wherein the light having the first color, the light having the second color, and the light having the third color are combined and emitted by the cavity as the combined light.

3. The lighting module of claim 1, wherein at least one of the plurality of reflective elements and the plurality of wavelength converting areas are rotatably movable with respect to the other.

4. The lighting module of claim 1, wherein at least one of the plurality of reflective elements and the plurality of wavelength converting areas are linearly movable with respect to the other.

5. The lighting module of claim 1, wherein the correlated color temperature of the combined light emitted by the cavity may be selected from approximately 4,000 Kelvin to approximately 2,700 Kelvin.

6. A method comprising:

emitting light from at least one light emitting diode (LED) into a cavity of a light emitting module, the light having a first color;

selectively blocking portions of a plurality of wavelength converting areas within the cavity from the light having the first color, wherein unblocked portions of the plurality of wavelength converting areas convert the light having the first color into light having a second color;

combining the light having the first color and the light having the second color within the cavity to produce a combined light having a first correlated color temperature;

emitting the combined light having the first correlated color temperature through a translucent window in sidewalls of the cavity; and selectively blocking different portions of the plurality of wavelength converting areas within the cavity from the light having the first color to produce the combined light having a second correlated color temperature.

7. The method of claim 6, wherein the translucent window forms the sidewalls of the cavity.

8. The method of claim 6, wherein the plurality of wavelength converting areas further convert the light having the first color to light having a third color, wherein the light having the first color, the light having the second color, and the light having the third color are combined to produce the combined light having the first correlated color temperature.

9. The method of claim 8, wherein selectively blocking portions of the plurality of wavelength converting areas comprises selectively blocking first portions of the plurality of wavelength converting areas that convert the light having the first color to light having the second color and selectively blocking second portions of the plurality of wavelength converting areas that convert the light having the first color to light having the third color.

10. The method of claim 6, wherein selectively blocking portions of the plurality of wavelength converting areas comprises rotatably moving at least one of a plurality of reflective elements and the plurality of wavelength converting areas with respect to the other.

11. The method of claim 6, wherein selectively blocking portions of the plurality of wavelength converting areas comprises linearly moving at least one of a plurality of reflective elements and the plurality of wavelength converting areas with respect to the other.

12. The method of claim 6, wherein the first correlated color temperature and the second correlated color temperature range between approximately 4,000 Kelvin to approximately 2,700 Kelvin.

* * * * *